US007226306B1

(12) United States Patent
Chen et al.

(10) Patent No.: US 7,226,306 B1
(45) Date of Patent: Jun. 5, 2007

(54) SOCKET WITH FORCE APPLYING MEMBER

(75) Inventors: Michael Chen, Taipei Hsien (TW); Tai-Wei Lin, Taipei Hsien (TW)

(73) Assignee: Topower Computer Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/297,346

(22) Filed: Dec. 9, 2005

(51) Int. Cl.
*H01R 13/627* (2006.01)

(52) U.S. Cl. ..... 439/350; 439/157; 439/160; 439/353

(58) Field of Classification Search ..... 439/35–354
See application file for complete search history.

(56) References Cited

U.S. PATENT DOCUMENTS 5,213,533 A * 5/1993 Walden ..... 439/372
5,219,459 A * 6/1993 Kaneko ..... 439/157
5,558,528 A * 9/1996 Cheng et al. ..... 439/160
5,740,012 A * 4/1998 Choi ..... 361/686
6,030,239 A * 2/2000 Liu ..... 439/160
6,476,318 B1 * 11/2002 Lee ..... 174/59
6,716,044 B2 * 4/2004 Bertke ..... 439/160

FOREIGN PATENT DOCUMENTS

TW 385070 3/2000
TW M271285 U 7/2005

* cited by examiner

*Primary Examiner*—Michael C. Zarroli
(74) *Attorney, Agent, or Firm*—Birch, Stewart, Kolasch & Birch, LLP

(57) ABSTRACT

A transmission line that is plugged and unplugged includes a wire and at least one socket connecting to one end of the wire. The socket is connected to an electronic device and coupled with a force applying member. The force applying member rams the electronic device when subject to a force to facilitate separation of the socket and the electronic device. The force applying member is hinged on the socket and is divided by the hinged location to form a force applying portion and a pressing portion. When the force applying portion receives the force, the pressing portion generates a counter force about the hinged location against the electronic device to make the socket to be removed from the electronic device.

18 Claims, 11 Drawing Sheets

SOCKET WITH FORCE APPLYING MEMBER

FIELD OF THE INVENTION

The present invention relates to a transmission line that is easily plugged and unplugged and particularly to a transmission line that has a force applying member hinged on a socket to facilitate plugging and unplugging.

BACKGROUND OF THE INVENTION

Nowadays computers are widely used in various industries or locations. The rapid advance of computer technology also constantly spawns new functions. For instance, multimedia applications need new peripheral devices such as CD-ROM optical drivers. The operation speed of the computers also is faster and produces higher temperature during operation. This requires a cooling fan to generate cooling airflow to dispel heat energy generated by the CPU chipset in the computer. These additional computer peripheral devices or cooling fan have to be coupled with a power supply socket on the computer to obtain power supply for operation.

The socket and insertion slot of the computer peripheral devices have to be tightly coupled to establish electric connection and to avoid short circuit or connection breakdown. Hence plugging and unplugging between the socket and the insertion slot generally are not easy and take a lot of efforts. The conventional power supply socket, such as R.O.C. patent publication No. 385070 entitled "Improved adapter for computer power supply" discloses a power supply socket that has protrusive members two sides to aid plugging and unplugging. A user grasps the protrusive members to do plugging or unplugging. But even resorting to the protrusive members still is difficult to overcome the tight coupling between the socket and the insertion slot to remove the socket from the insertion slot. Users often have to shake the socket left and right, and up and down to loosen the socket before removing. Some times even the power cord has to be pulled to aid removing of the socket. This could cause damage of the connection terminal and dislocation. As a result, plugging next time could be difficult and poor contact could occur. This is troublesome to users. Moreover, the design of 4P socket at present usually adopts an equal length for the ground terminal and fire terminal. The socket often has a plurality of fire terminals with different potentials. As the ground terminal is located in the center, and the fire terminals are located on the left side and right side, shaking the socket causes the fire terminals to make contact first (or the ground terminal to loosen off first). This results in not equal potential of the disconnected electronic device and the power supply, and the floating voltage rises. It affects the electronic device. This phenomenon is especially obvious in the plug-and-play condition. Even not in the plug-and-play condition, the power supply and electronic device still have potential due to existing of scattering capacitance. Hence discharge to the ground does not take place due to no common ground. In addition to the disadvantages mentioned above, a slight arc occurs due to the male and female fire terminals do not share the common ground. This phenomenon increases the impedance of the fire terminals and affects electric characteristics.

To remedy the aforesaid problems, R.O.C. patent publication No. M271285 entitled "Power supply connector" discloses an improved socket that has an arched and elastic pressing plate on a upper end surface of the socket. The pressing plate has one end anchored on a rear end of the upper end surface and is extended to the coupling location of the socket and the insertion slot. It has a ramming surface on a front end surface. The arched portion of the pressing plate has a plurality of ridges on a upper end. The male connector has a jutting force applying surface on the bottom end. The force applying surface further is extended downwards to form a conical surface. When the socket and the insertion slot are coupled, the front end surface of the insertion slot pushes the ramming surface of the pressing surface which is deformed rearwards in an arched manner. Hence a return action force directing forwards is generated on the pressing plate. When there is a desire to separate the socket and the insertion slot, user's finger depresses the conical surface on the lower side of the force applying surface, another finger depresses the pressing plate downwards, the ramming surface on the front end of the pressing plate generates a thrust force directing forwards to press the insertion slot. Thereby the insertion and the socket can be separated, and the socket can be removed. The connector set forth above has the pressing plate located on the upper end surface of the socket to aid the applying force. For the modern computer peripheral devices such as optical disk drives or hard disk drives that adopt new specifications of SATA sockets, the wires are vertically inserted into the SATA socket by piercing. If the connector previously discussed is adopted on the SATA socket, the pressing plate will hinder the vertically inserting wires and coupling becomes not possible. In other words, the connector mentioned in the previous patent cannot be adopted on the SATA socket. Thus its applicability is limited.

SUMMARY OF THE INVENTION

In view of the drawbacks and limitations occurred to the conventional techniques, the present invention aims to provide a transmission line that can be easily plugged and unplugged to conform to the industrial specifications and to facilitate user operation.

The primary object of the invention is to provide a transmission line that is easily plugged and unplugged. It has a force applying member hinged on a socket. To remove the socket from an insertion slot, in can be easily accomplished by applying a force on the force applying member. The transmission line of the invention is adaptable to various types of connectors to improve operation convenience and enhance applicability in the industry.

The transmission line of the invention includes a wire and at least one socket connecting to one end of the wire. The socket aims is connected to an electronic device and also is coupled with a force applying member. The force applying member rams the electronic device when subject to a force to make separation of the socket and the electronic device easier. The force applying member is hinged on the socket and divided by the hinged location to form a force applying portion and a pressing portion. When the force applying portion receives a force, the pressing portion generates a counter force about the hinged location to make separation of the socket and the electronic device easier. Hence by means of the construction set forth above, users can easily unplug the socket from the electronic device.

The foregoing, as well as additional objects, features and advantages of the invention will be more readily apparent from the following detailed description, which proceeds with reference to the accompanying drawings. It is to be noted that the drawings and discussion below serve only for illustrative purpose, and are not the limitation of the invention.

DETAILED DESCRIPTION OF THE PREFERRED EMBODIMENTS

Figure 1:
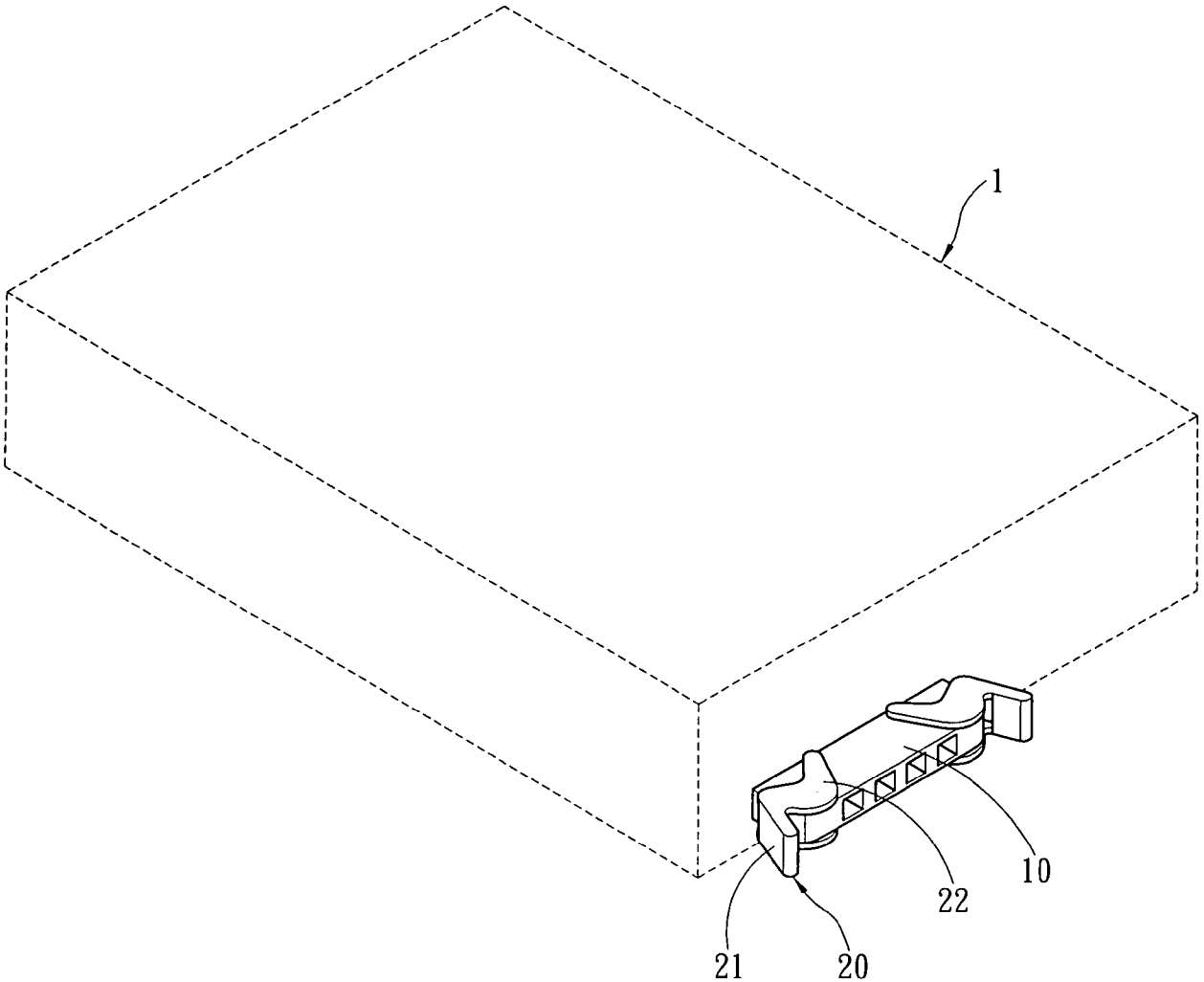
FIG. 1 is a schematic view of the present invention in a use condition.
Figure 2:
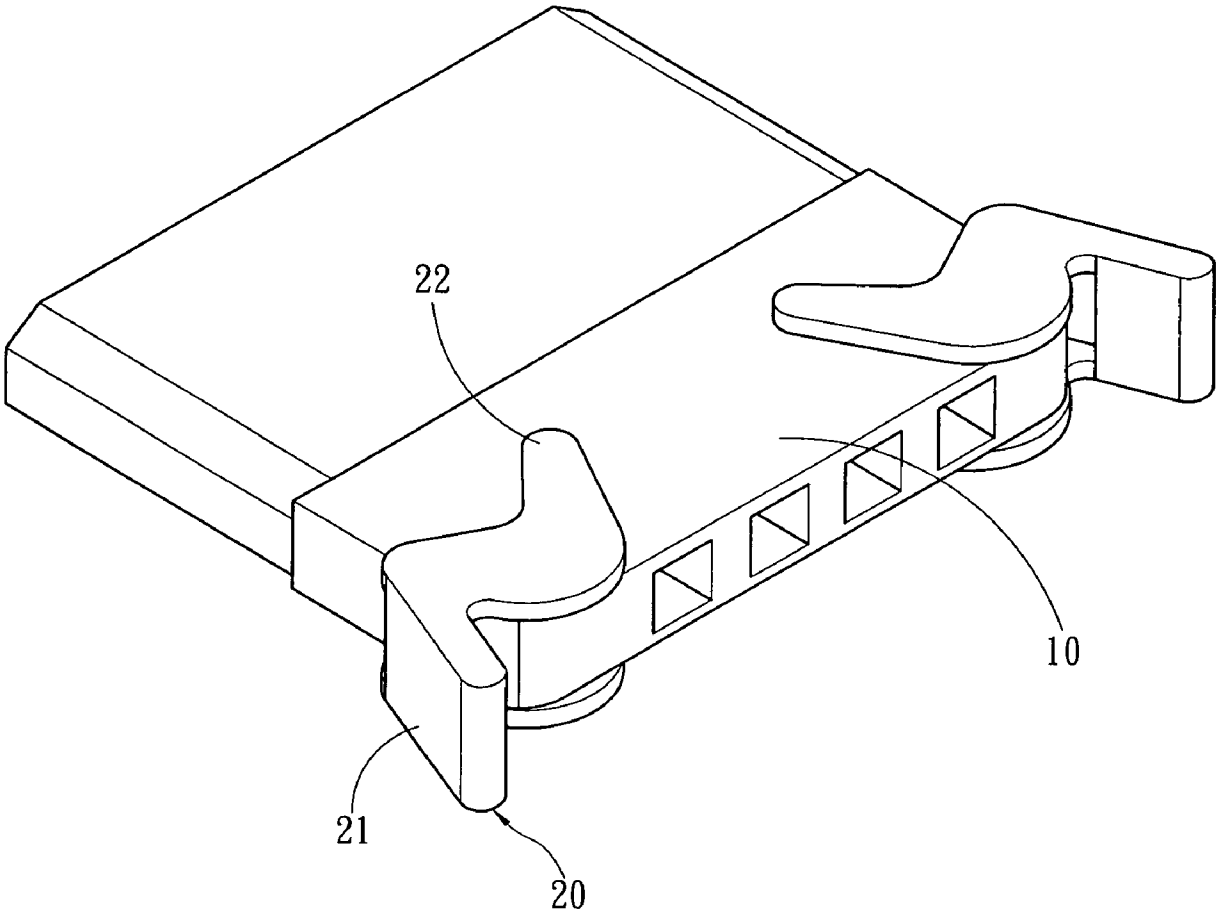
FIG. 2 is a perspective view of the present invention.
Figure 3:
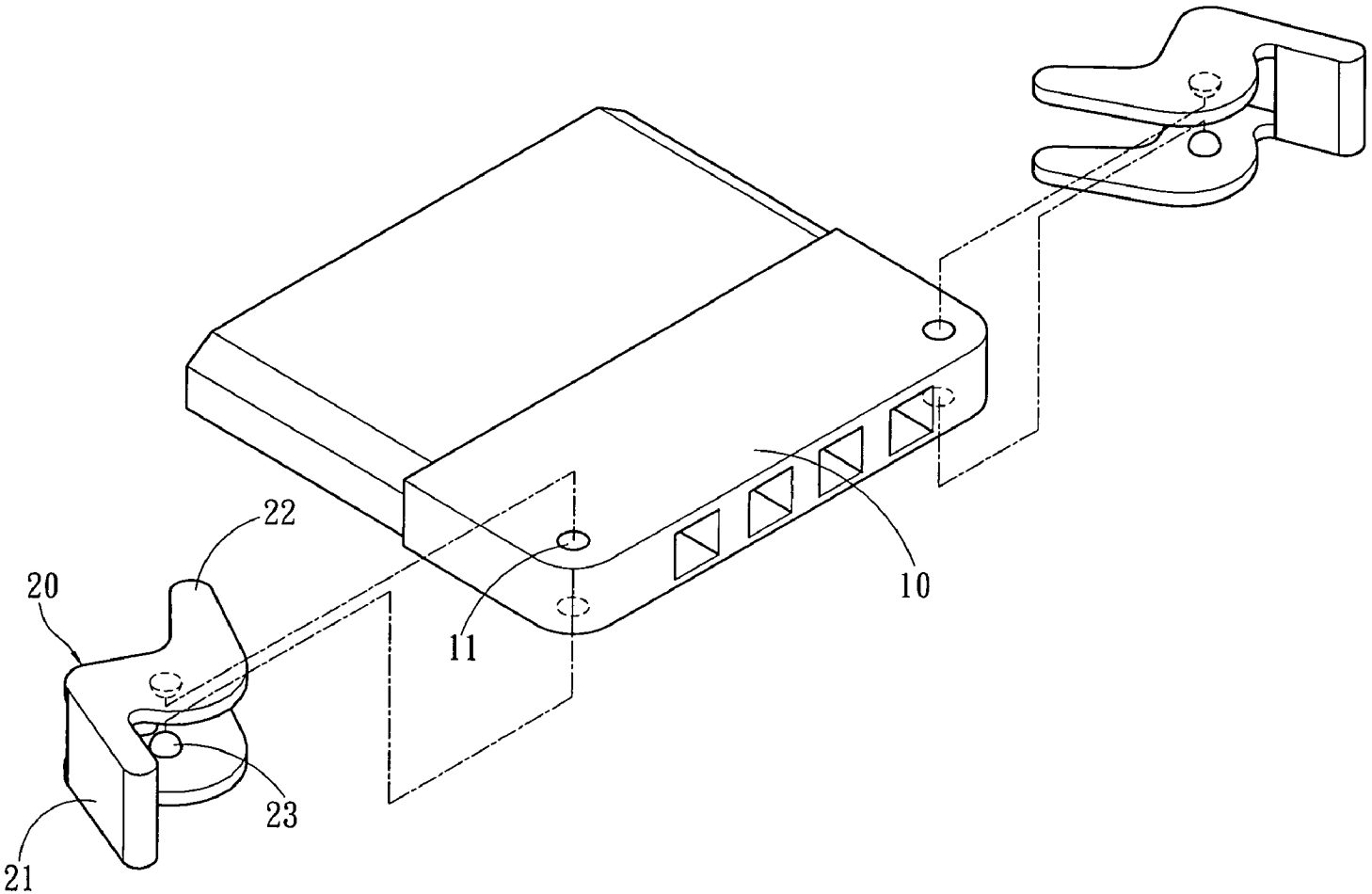
FIG. 3 is an exploded view of the present invention.

Please refer to FIGS. 1, 2 and 3 for the invention in a use condition and the perspective and exploded views. The transmission line according to the invention includes a wire and at least a socket 10 connecting to one end of the wire. The wire may be a conventional one, and forms no part of the invention, thus is not shown in the drawings. The socket 10 is coupled with an electronic device 1 which may be a computer peripheral device (such as hard disk drive or the like) or other electronic devices. The socket 10 is coupled with a force applying member 20 which presses the electronic device 1 when subject to a force to make the socket 10 to be separated easily from the electronic device 1. The force applying member 20 is hinged on the socket 10. The force applying member 20 has an anchor boss 23. The socket 10 has a retaining hole 11 corresponding to the anchor boss 23 to be hinged by the force applying member 20 (or an axle may be provided to form the hinge effect). The force applying member 20 is divided by the hinge location to form a force applying portion 21 and a pressing portion 22. When the force applying portion 21 is subject to the force, the pressing portion 22 generates a counter force to the electronic device 1 about the hinge location to make separation of the socket 10 and the electronic device 1 easier.

Figure 4A:
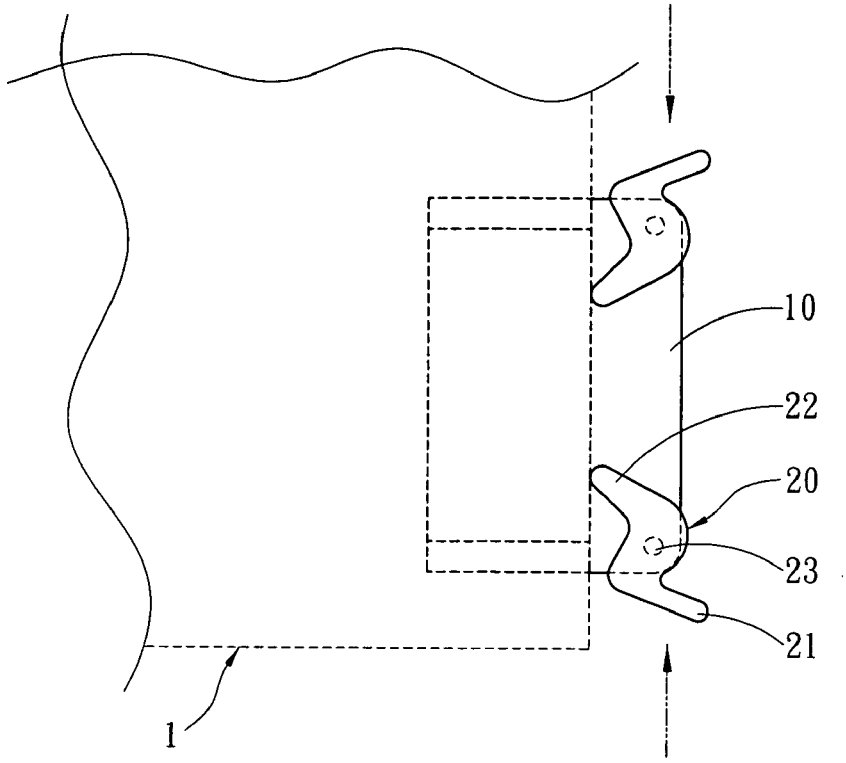
FIGS. 4A, 4B and 4C are schematic views of the present invention in operating conditions.
Figure 4B:
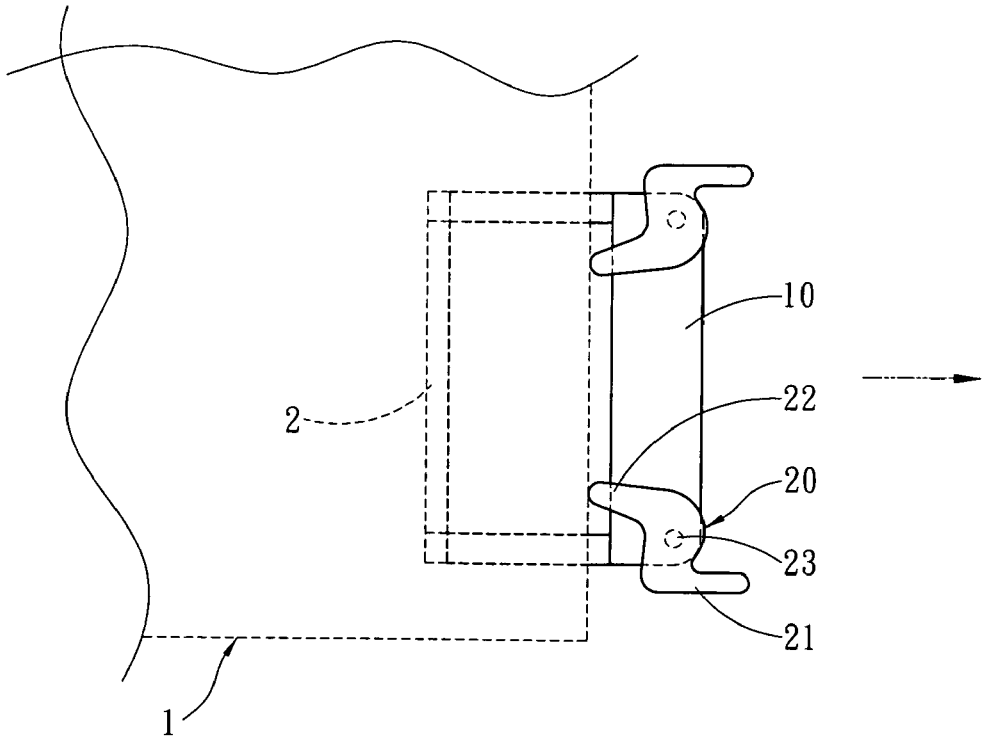
Figure 4C:
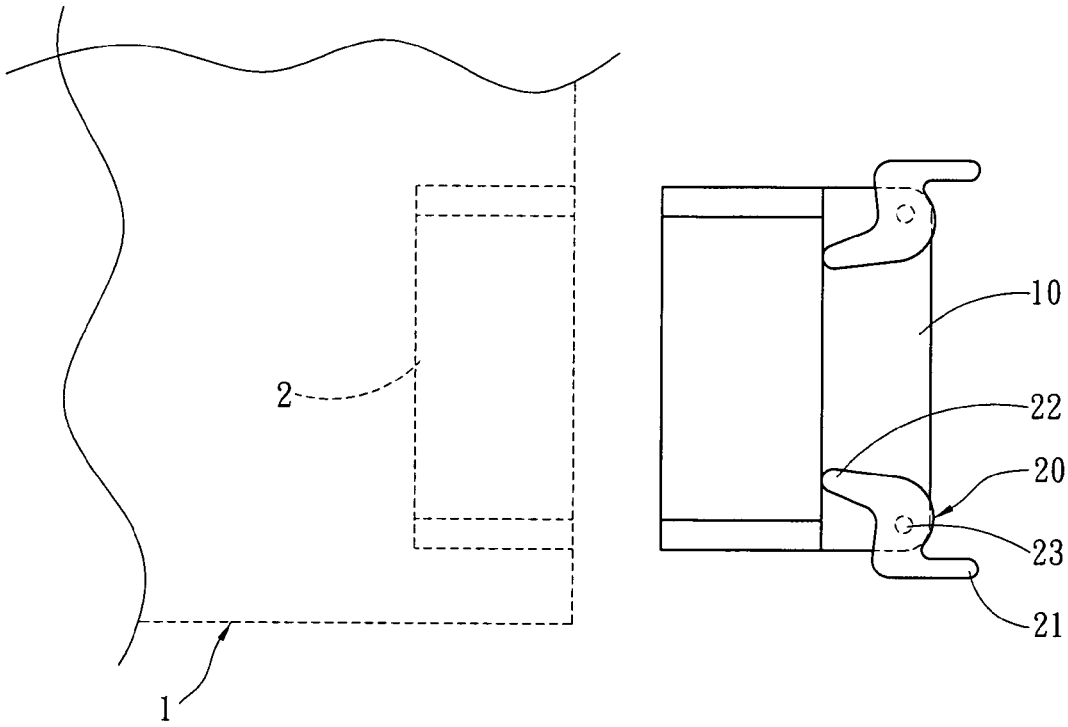

Refer to FIGS. 4A through 4C for the invention in operating conditions. The socket 10 is coupled with an insertion slot 2 of the electronic device 1. When a user depresses the force applying portion 21 of the force applying member 20 inwards from two sides (as shown in FIG. 4A), the pressing portion 22 rocks about the hinged location which functions as a fulcrum, and through a lever principle, an outward swiveling track occurs and a counter action is generated to ram the electronic device 1; thereby the socket 10 is retracted rearwards from the insertion slot 2 (as shown in FIG. 4B). As a result, the socket 10 and the insertion slot 2 are not coupled as tightly as that shown in FIG. 4A, and a loosening occurs. Then the user can easily remove the socket 10 from the insertion slot 2 by pulling the socket 10 (as shown in FIG. 4C).

Figure 5A:
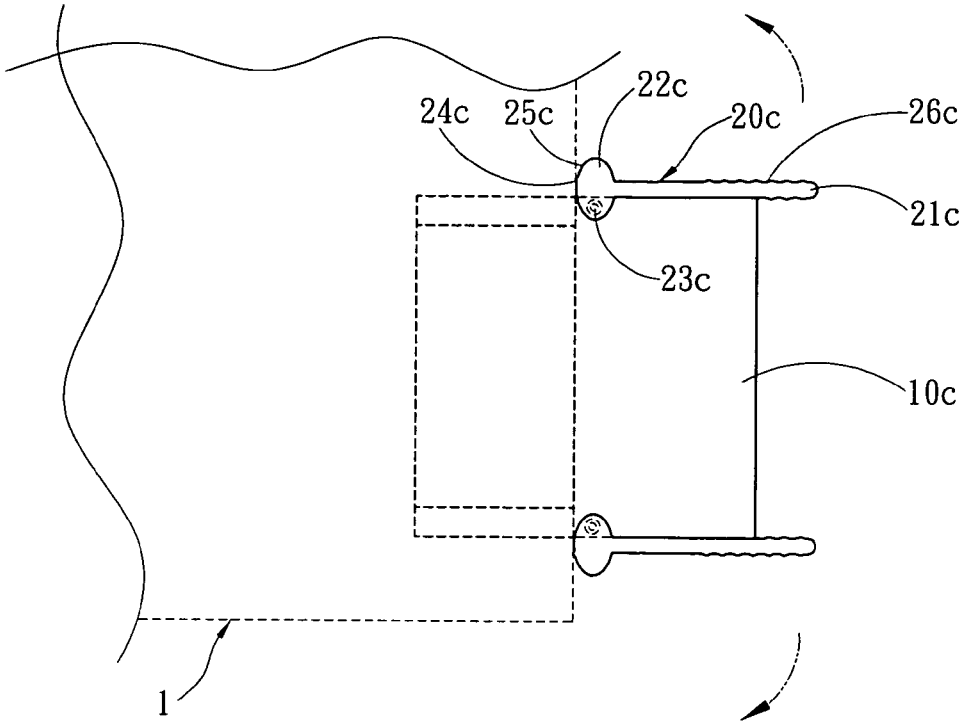
FIGS. 5A through 5D are schematic views of an embodiment of the present invention in operating conditions.
Figure 5B:
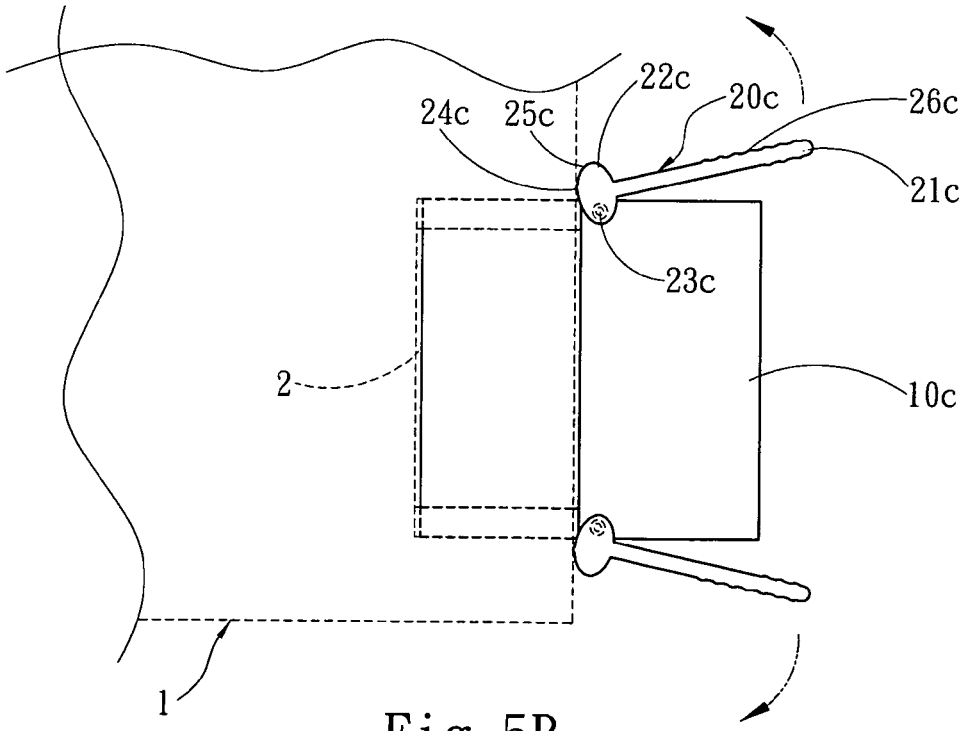
Figure 5C:
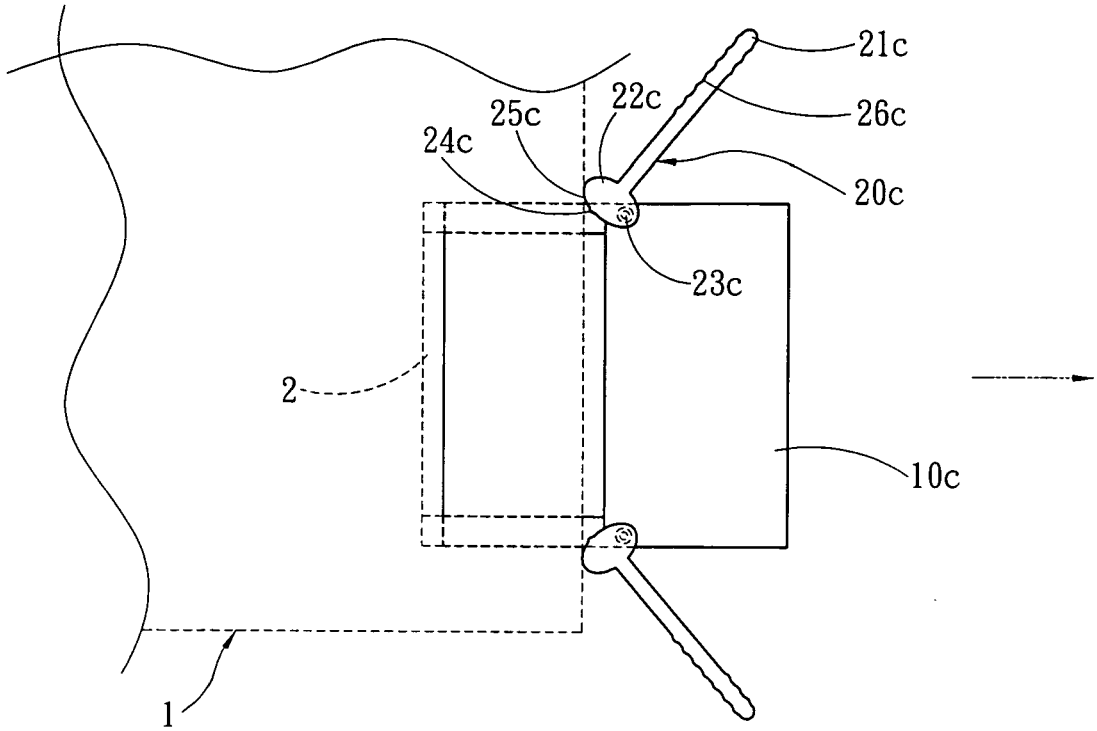
Figure 5D:
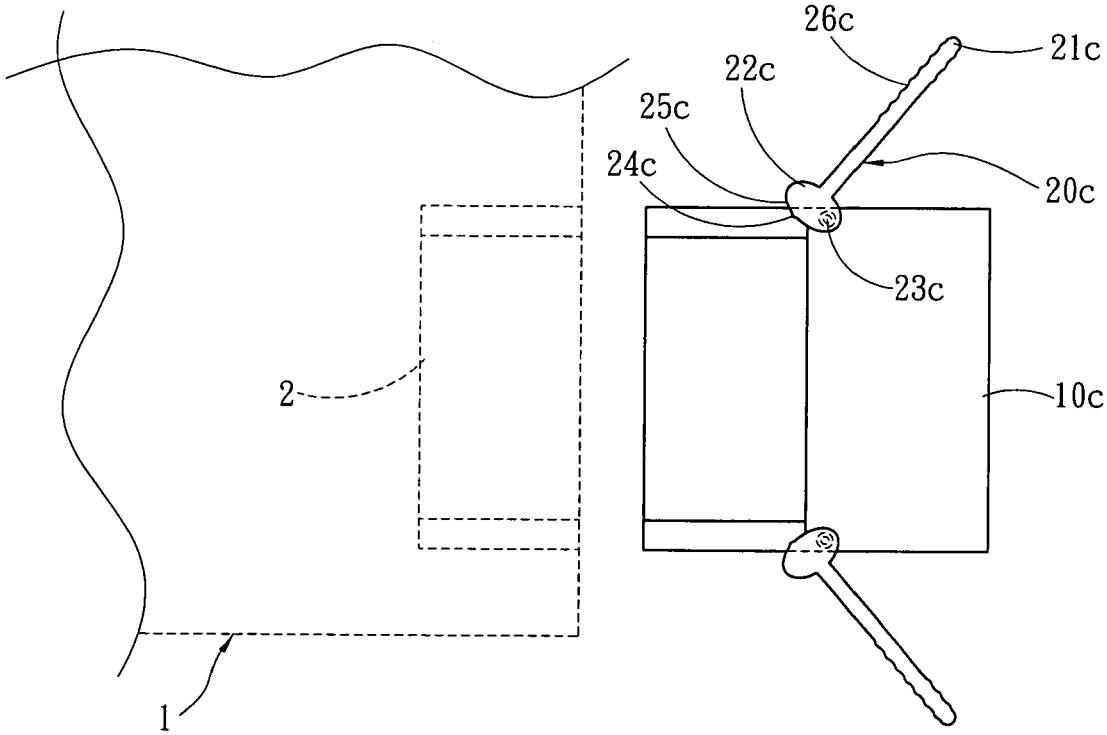

Adopted the design concept of the invention, the force applying member 20 can be formed in various styles without restrictions. FIGS. 5A through 5D illustrate an embodiment. The pressing portion 22*c* has an arched portion 25*c* which has a bulged spot 24*c* to press the electronic device 1. The force applying portion 21*c* further has ridges 26*c* (referring to FIG. 5A) to aid force applying. When the force applying portion 21*c* receives a force, the arched portion 25*c* generates a swiveling track, and the bulged spot 24*c* rams the electronic device 1 to retract the socket 10*c* rewards from the insertion slot for a selected distance (referring to FIG. 5B). In the event that a pulling force exerted by the user still cannot separate the socket 10*c* from the insertion slot 2, the user can exert a force on the force applying portion 21*c* to make the arched portion 25*c* to ram against the electronic device 1 to generate a counter force so that the socket 10*c* can be retracted from the insertion slot 2 for a longer distance (as shown in FIG. 5C); then the user can easily pull and remove the socket 10*c* from the insertion slot 2 (as shown in FIG. 5D).

Figure 6A:
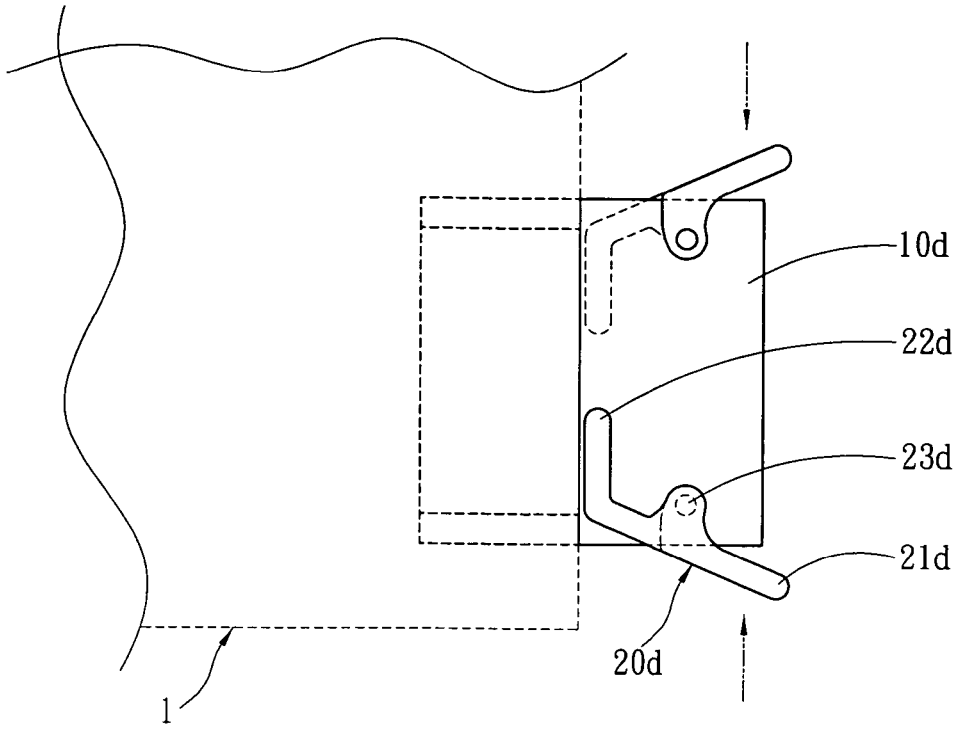
FIGS. 6A through 6C are schematic views of another embodiment of the present invention in operating conditions.
Figure 6B:
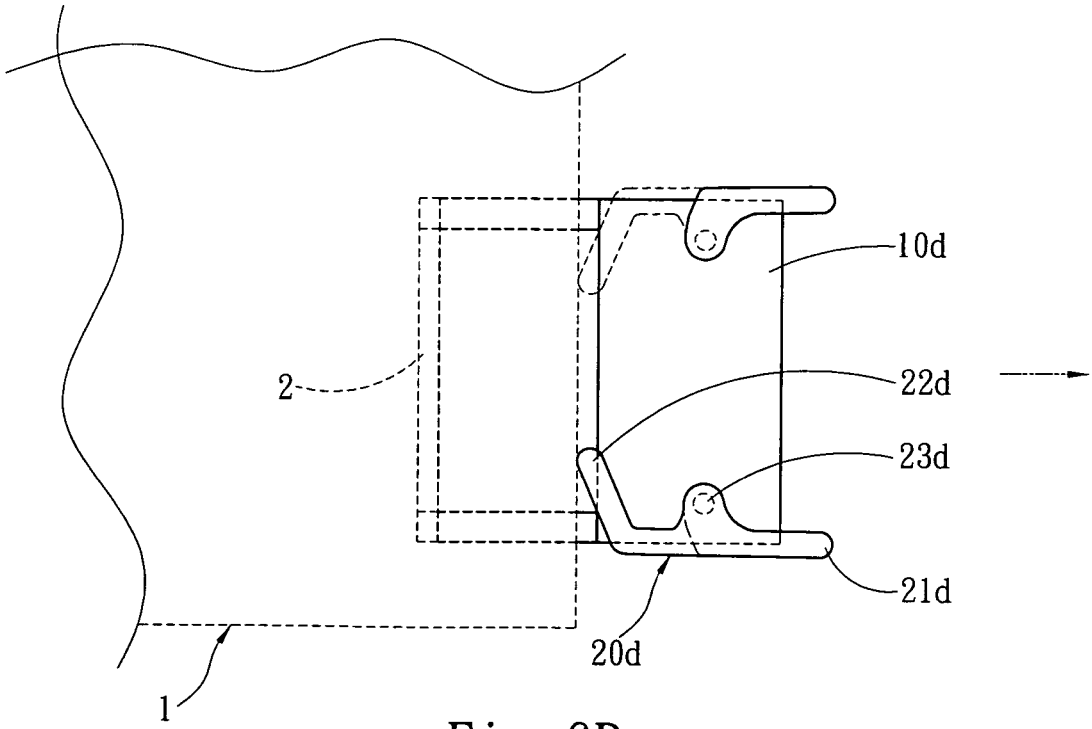
Figure 6C:
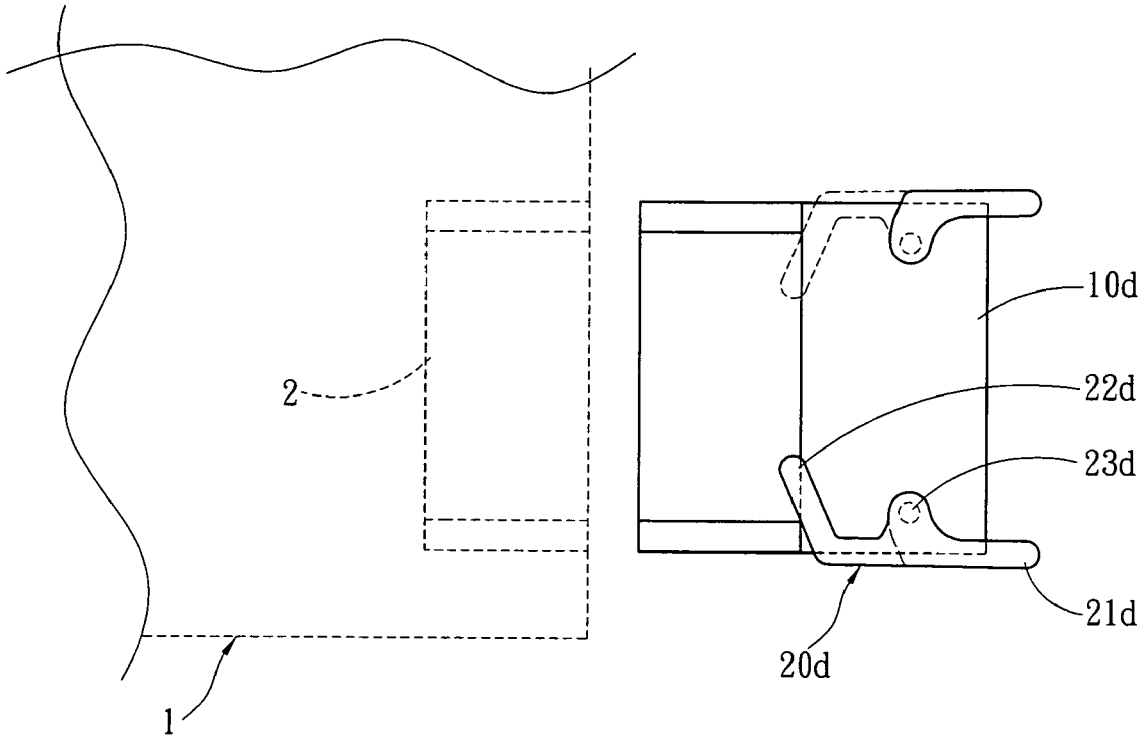
Figure 7A:
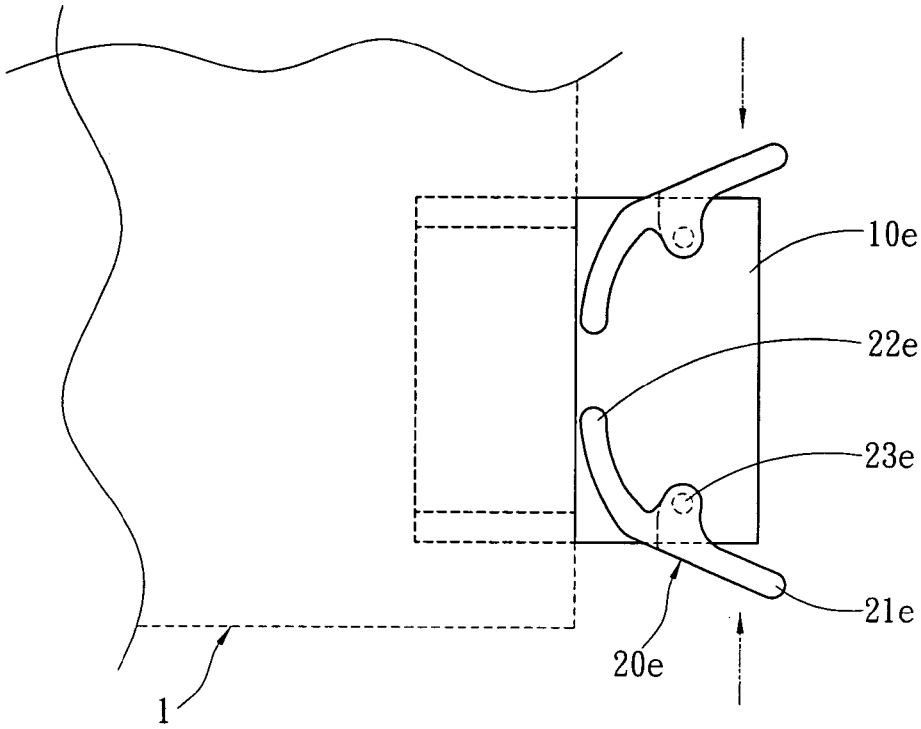
FIGS. 7A through 7C are schematic views of yet another embodiment of the present invention in operating conditions.
Figure 7B:
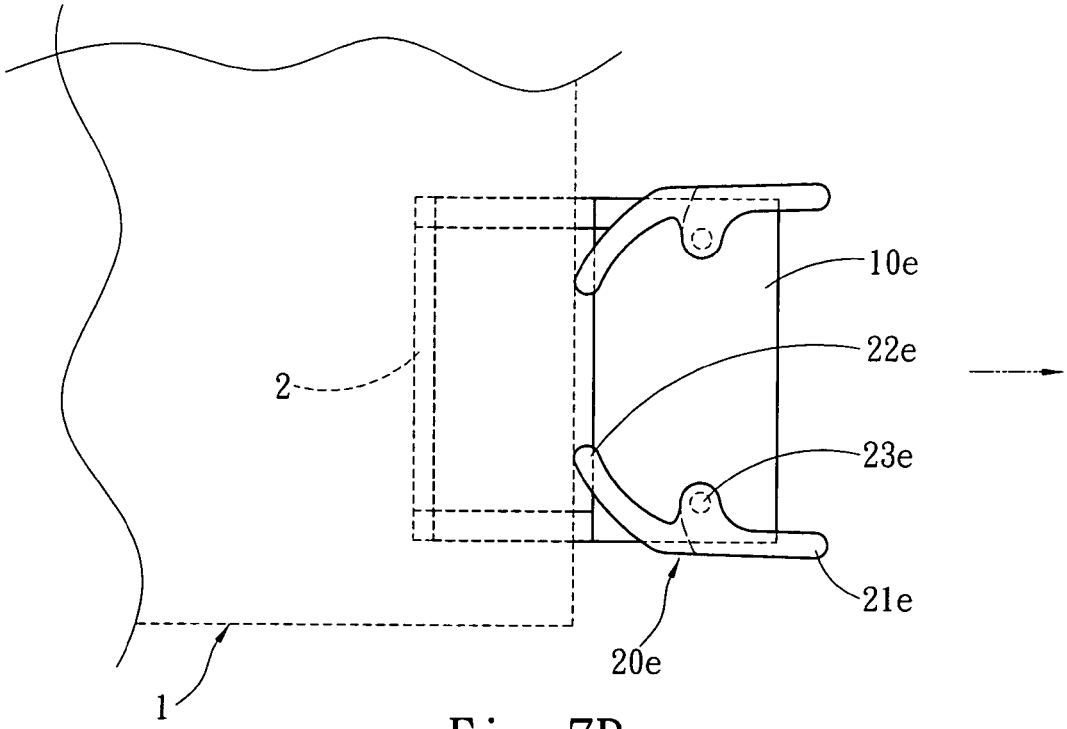
Figure 7C:
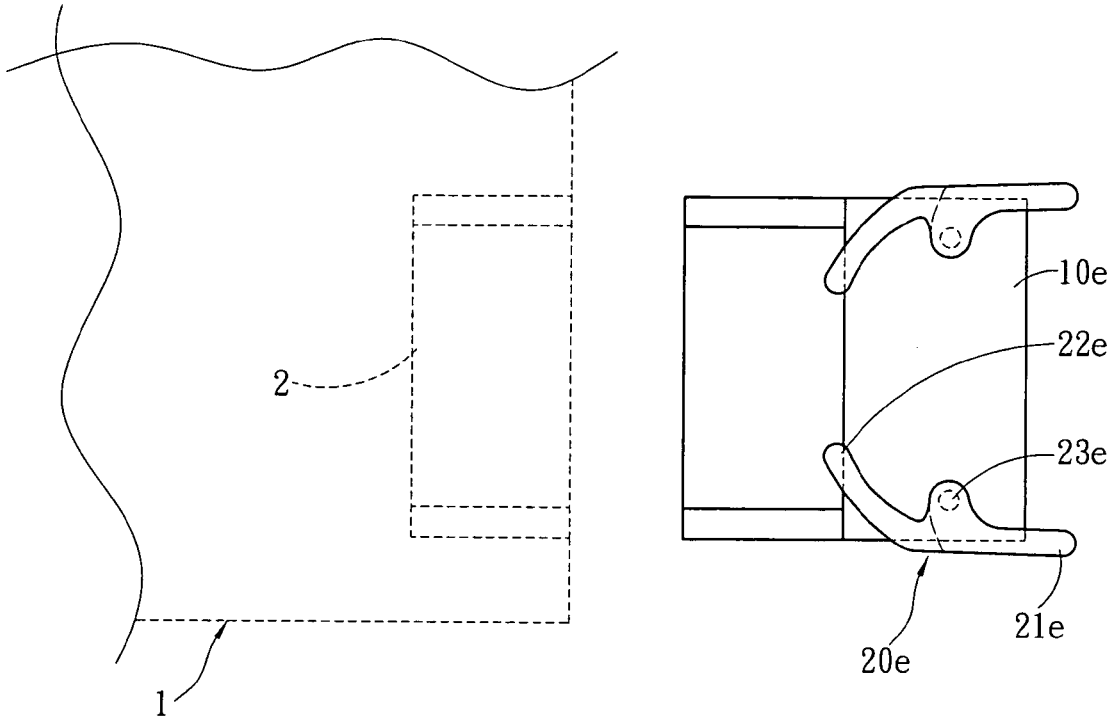

Refer to FIGS. 6A through 6C for another embodiment of the invention. The socket 10*d* has two sides each has a force applying member 20*d*. The force applying member 20*d* has a pressing portion 22*d* which has a upper portion and a lower portion on different surfaces of the socket 10*d*. Such a structure also can aid plugging and unplugging of the socket. Its operation principle and implementation are substantially same as the one previously discussed. Hence details are omitted. Refer to FIGS. 7A through 7C for yet another embodiment of the invention. The transmission line of the invention, aside from being adapted to various types of force applying member 20*e*, can also suit various types of sockets 10*e*, such as a 4-Pin socket (generally called Big 4P) conforming to IDE specification to be used on computer peripheral devices such as optical disk drives or hard disk drives. The force applying member 20*e* is located on each of two sides of the socket 10*e* to prevent hindering of wiring of SATA sockets. Thus the invention can be adopted on the SATA sockets. It also can be adopted on 24 or 20 PIN sockets used on motherboards, 6PIN sockets conforming to PCI-E specification used on VGA cards, or other wiring connection elements for power and signal transmission and the like to provide easy plugging and unplugging functions.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A transmission line easily plugged and unplugged, comprising a wire and at least one socket connecting to one end of the wire, the socket being connected to an electronic device and coupled thereto, the socket being provided with a non-coupling force applying member, the non-coupling force applying member ramming the electronic device when subject to a force facilitate separation of the socket and the electronic device;

wherein the non-coupling force applying member is hinged on the socket and divided by the hinged location to form a force applying portion and a pressing portion, the force applying portion receiving the force to allow the pressing portion to generate a counter force about the hinge location on the electronic device to separate the socket from the electronic device;

wherein the non-coupling force applying member has an axle, the socket having a retaining hole corresponding to the axle to be hinged with the non-coupling force applying member.

2. The transmission line of claim 1, wherein the non-coupling force applying member has a plurality of ridges to facilitate applying of the force.

3. The transmission line of claim 1, wherein the pressing portion has an arched portion which generates a swiveling track when the non-coupling force applying member receives the force to ram the electronic device to generate the counter force.

4. The transmission line of claim 3, wherein the arched portion has a bulged spot to ram the electronic device.

5. The transmission line of claim 1, wherein the socket has one side which is coupled with the non-coupling force applying member.

6. The transmission line of claim 1, wherein the socket has two sides each being coupled with one non-coupling force applying member.

7. The transmission line of claim 6, wherein the pressing portions of the two non-coupling force applying members are located on a same surface of the socket.

8. The transmission line of claim 6, wherein the pressing portions of the two non-coupling force applying members are located on two corresponding surfaces of the socket.

9. The transmission line of claim 6, wherein the two non-coupling force applying members have respectively a pressing portion which is located on one of two corresponding surfaces of the socket.

10. A transmission line easily plugged and unplugged, comprising a wire and at least one socket connecting to one end of the wire the socket being connected to an electronic device and coupled thereto, the socket being provided with a non-coupling force applying member, the non-coupling force applying member ramming the electronic device when subject to a force facilitate separation of the socket and the electronic device;

wherein the non-coupling force applying member is hinged on the socket and divided by the hinged location to form a force applying portion and a pressing portion, the force applying portion receiving the force to allow the pressing portion to generate a counter force about the hinge location on the electronic device to separate the socket from the electronic device;

wherein the socket has a retaining hole and the non-coupling force applying member has an anchor boss corresponding to the retaining hole to form the hinge condition.

11. The transmission line of claim 10, wherein the non-coupling force applying member has a plurality of ridges to facilitate applying of the force.

12. The transmission line of claim 10, wherein the pressing portion has an arched portion which generates a swiveling track when the non-coupling force applying member receives the force to ram the electronic device to generate the counter force.

13. The transmission line of claim 12, wherein the arched portion has a bulged spot to ram the electronic device.

14. The transmission line of claim 10, wherein the socket has one side which is coupled with the non-coupling force applying member.

15. The transmission line of claim 10, wherein the socket has two sides each being coupled with one non-coupling force applying member.

16. The transmission line of claim 15, wherein the pressing portions of the two non-coupling force applying members are located on a same surface of the socket.

17. The transmission line of claim 15, wherein the pressing portions of the two non-coupling force applying members are located on two corresponding surfaces of the socket.

18. The transmission line of claim 15, wherein the two non-coupling force applying members have respectively a pressing portion which is located on one of two corresponding surfaces of the socket.

* * * * *